US005125662A

United States Patent [19]

Antonious

[11] Patent Number: 5,125,662

[45] Date of Patent: Jun. 30, 1992

[54] SET OF IRON TYPE GOLF CLUB HEADS WITH INTEGRAL SKID MEMBERS ON THE SOLE

[76] Inventor: Anthony J. Antonious, 205 E. Joppa Rd., Towson, Md. 21204

[21] Appl. No.: 493,288

[22] Filed: Mar. 14, 1990

Related U.S. Application Data

[63] Continuation-in-part of Ser. No. 393,091, Aug. 1, 1989, abandoned, which is a continuation-in-part of Ser. No. 125,568, Nov. 25, 1987, abandoned.

[51] Int. Cl.[5] ..... A63B 53/04

[52] U.S. Cl. ..... 273/167 A; 273/174

[58] Field of Search ..... 273/167 A, 174

[56] References Cited

U.S. PATENT DOCUMENTS 1,089,881 3/1914 Taylor, Jr. ..... 273/167 A
1,128,288 2/1915 Churchill ..... 273/167 A
4,332,388 6/1982 Crow ..... 273/174
4,838,555 6/1989 Kobayashi ..... 273/167 A

*Primary Examiner*—William H. Grieb
*Assistant Examiner*—Raleigh W. Chiu
*Attorney, Agent, or Firm*—Nicholas J. Aquilino

[57] ABSTRACT

An iron type golf club head having raised, spaced skid members projecting from the sole and raising the sole above the ground surface for minimizing friction between the club head and the ground surface during the execution of the swing. The skid members are elongated and have a forward portion of the ground engaging surface coincident with the leading edge of the club head enabling the leading edge to be flush with the ground surface and where the remaining portion of the ground engaging surface of the skid members are progressively further spaced from the sole in the front to rear direction thereby raising the sole above the ground surface.

18 Claims, 3 Drawing Sheets

SET OF IRON TYPE GOLF CLUB HEADS WITH INTEGRAL SKID MEMBERS ON THE SOLE

RELATED APPLICATIONS

The present invention is a continuation-in-part of Ser. No. 07/393,091 filed Aug. 1, 1989, now abandoned, which in turn is a continuation-in-part of Ser. No. 07/125,568 filed Nov. 25, 1987, now abandoned.

BACKGROUND OF THE INVENTION

The present invention relates to iron type golf club heads, and in particular to a set of iron type golf club heads having skid members formed on the sole at a specific angular position relationship to the club head's hosel and face loft.

When using an iron type golf club head for hitting a golf ball from a ground surface such as a fairway, heavy grass, hard or rocky ground, a sand trap or other naturally occurring ground areas, a descending blow is used in order to properly execute a shot. This causes a substantial portion of the club head sole to encounter resistance from the ground surface causing the club head to decelerate considerably and to have a tendency to torque or turn because of the resistance encountered.

Golf clubs of the known prior which use sole configurations to lessen contact of the sole with the ground surface include those shown to Scott U.S. Pat. No. 1,531,821, Stumpf U.S. Pat. No. 1,913,821, Golden U.S. Pat. No. 3,992,013, Sano U.S. Pat. No. 3,068,011, Gordos U.S. Pat. No. 4,065,133 and Crow U.S. Pat. No. 4,332,388. All of these golf clubs have relatively flat sole surfaces to which the runners are added thereby raising the entire club head including the leading edge of the club head, above the ground surface. This requires that the club be swung in a sweeping fashion in order to eliminate the bounce which would be encountered when the runners initially hit the ground surface. Whereas this arrangement works fairly well with wood type golf club heads, it becomes a disadvantage for iron type club heads which require the leading edge to penetrate the ground surface during the execution of a shot. For example, the patent to Crow, listed above, discloses a wood-type golf club head having runners which has wide spread use in the golfing community. As seen from his FIGS. 1 and 3, the bottom sole 18 and the corresponding leading edge 34 are raised above the ground surfaces by the height of the runner members 26 and 28. Providing this type of configuration on an iron would not permit the leading edge of the club head to properly get down below the ball in order for it to make proper contact on the ball striking face adjacent the center of percussion (CP). The resulting bounce would cause the club to strike the ball nearer the bottom of the club head resulting in an undesirable bladed or sculled shot which a golfer cannot control.

SUMMARY OF THE INVENTION

The present invention relates specifically to a set of iron type golf club heads using skid members on the sole of the club head wherein the bottom surface of the skid member maintains a 90 degree angle with respect to the vertical axis of the club head through the golf club shaft. Stated in other words, the angle degrees between the bottom surface of the skid members and the club face plus the angle degrees between the club face and the vertical axis, is 90 degrees. The skid members taper from the leading edge toward the rear of the club head at a gradually increasing angle so that the sole of the club head regardless of its contour is raised above the ground surface at an angle from the front to the rear of the club head.

The skid members are positioned between the toe and heel portion of the golf club head and have their longitudinal axis extending in the front to rear direction. Skid members start precisely at the leading edge of the club head so that the leading edge is not raised above the ground engaging surface at address or when properly contacting the ball. As the skid members taper rearwardly, the sole of the club head is gradually raised so that the skid members initially contact the ground surface while the remaining portion of the sole is raised above the ground surface thereby eliminating undesirable bounce, particularly if the shot is being played from a divot or hard ground surface. Each skid member is located on opposite sides of and an equal distance adjacent to the center of gravity (CG) of the club head.

The skid members are provided with various shapes having smooth surfaces in every direction to lessen club head resistance from the ground surfaces as a ball is being struck and ground contact is made.

When the club head is in the proper address position, the lower surfaces of the skid members are parallel to the ground and the angle between these surfaces and the club face angle and the angle of the golf club with the vertical are complementary. The structure allows the club head to contact the ground surface only on the much smaller raised surfaces of the skid members during the execution of a golf stroke instead of having approximately the entire central bottom surface or sole of the club head make contact thereby decreasing club head speed incurring turning and torquing, or causing the club head to bounce.

A golf club head of the present invention maintains the precise 90 degree angle relationship between the bottom of the skid members and the vertical axis of the golf club for each individually lofted iron in the set. This improvement raises the sole of the club head above the ground surface and permits the club head, as it makes ground contact, to more easily glide through or penetrate the ground producing narrow track-like furrows and to reach a level position parallel with the ground while maintaining the precise face loft of the respective club using only the skid members as the primary ground engaging point. The club head actually glides through or more easily penetrates into the ground surface since there is less overall area on the bottom of the club head to initially contact the ground during the execution of a stroke. The skid member actually furrows into the ground surface upon contact preventing lateral club head movement. This in turn permits the club head face to get more under the ball, and thereby contacting more of the ball for considerably greater ball striking control and performance.

In normal heights of grass the skid members not only substantially deflect the blades of grass, but also prevent the club head from penetrating too deeply into the turf thereby keeping the club face much cleaner so that grass and dirt will not affect the ball as it is being struck. In deep grass, the skid members keep the club head above the ground surface so that the full width of the leading edge of the ball striking face does not penetrate deeply into the grass, thereby stabilizing the club head and preventing it from twisting and decelerating due to the increased resistance encountered. On hard ground, the skid members will slide across the ground surface preventing the leading edge of the club head from either bouncing or digging too deeply into the ground thereby maintaining a more consistant ground contact in order to retain the proper loft angle of the club face relative to the ground thereby enabling the ball to be lofted considerably higher into the air and further into the target.

Among the objects of the present invention is to provide a new and improved iron type golf club head having a sole with skid members which lessen the contact surface of the club head lessens the effect of ground resistance the club head during the swing; to provide a golf club head which lessens the effect of ground resistance as a ball is being struck; and to provide an iron type golf club which maintains the respective proper club face loft angle when encountering resistance during the golf swing.

Other objects and advantages will become apparent from the following description and drawings.

DESCRIPTION OF THE PREFERRED EMBODIMENTS

Figure 1:
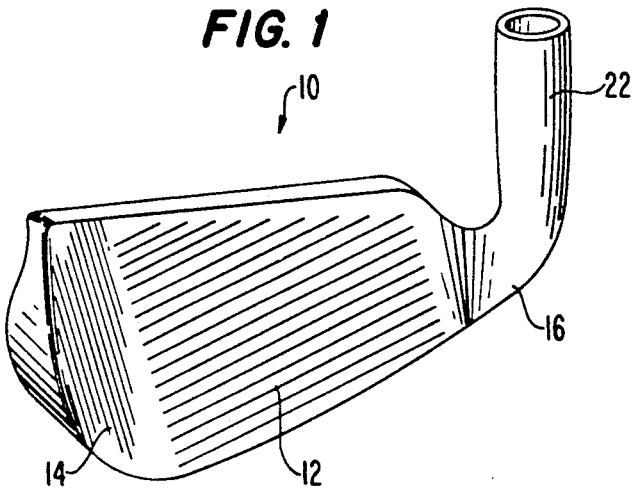
FIG. 1 is a front perspective view of an iron type golf club head of the present invention.
Figure 2:
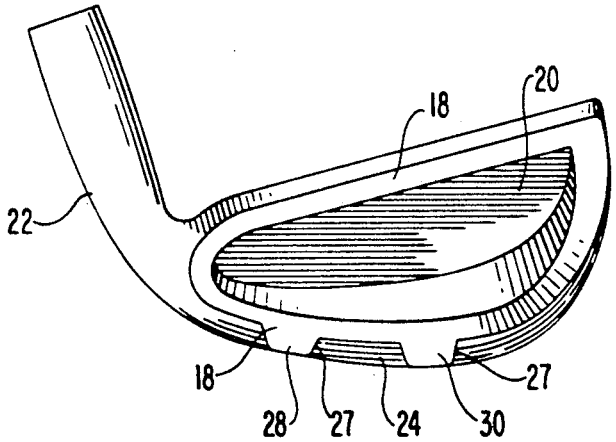
FIG. 2 is a rear elevational view of FIG. 1.

FIGS. 1 to 4 illustrate a first embodiment of a conventional cavity back type iron golf club head 10 including a ball striking face 12, toe 14, heel 16, rear surface 18 having a cavity 20, a hosel 22, and a sole 24 on the bottom surface of the club head 10. The club head 10 includes a leading edge 26 formed at the juncture of the ball striking face 12 and the sole 24. The club head is provided with a pair of skid members 28 and 30 located on the sole 24. Each of the skid members are generally rectangular in shape having a raised flat or radiused ground engaging surface and edges which are smooth or radial in shape to provide minimum resistance when they engage any ground surface obstacles as the club head is swung. The forward portion of the ground engaging surfaces are coincident with the leading edge 26 at that point, and the skid members 28 and 30 increase in height progressively further from the sole in the front to rear direction, thereby raising the sole above the ground surface. The tapering of the members 28 and 30 forms sides 27 which increase in size from the front to the rear direction.

Figure 3:
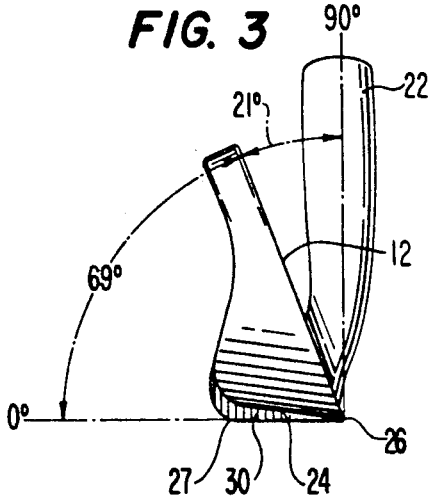
FIG. 3 is an end elevational view thereof.
Figure 4:
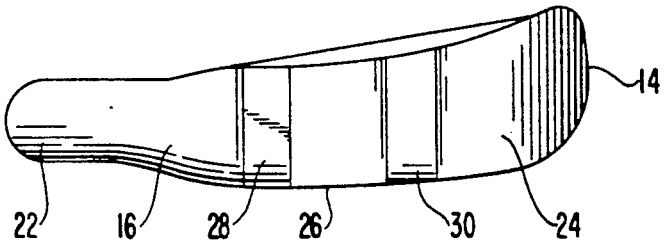
FIG. 4 is a bottom view of the golf club of the present invention.

Referring to FIG. 3, it can be seen that the ground engaging surfaces of the skids 28 and 30 form a 90 degree angle with respect to the vertical axis of the club as defined by a line extending through the hosel. It can be seen from FIGS. 2 and 3 that the sole 24 is gradually raised above the ground toward the rear surface 18 of the club head 10 from the leading edge 26 due to the tapered shape of each of the sides 27 of the skid members 28 and 30, respectively leaving only the ground engaging surfaces of the skid members 28 and 30 to contact the ground surface during a golf swing.

In a preferred embodiment of the invention, the skid members would be approximately ⅜ of an inch wide, and approximately ¾ to 1¼ inches long, and may extend across a portion of or the entire width of the sole 24 in the front to rear direction. Skids are separated from each other in a heel to toe direction by a distance of a minimum of ½ inch to a maximum of 1½ inches depending upon the size of the club head. Preferably, the width of the skid members 28 and 30 would be at least half the distance of their length, that is half the distance between the leading edge 26 and the rear surface 18 of the club head. The height of each skid member would taper up to approximately ¼ inch. As can be seen from FIG. 3, the angle from the bottom of the ground engaging surface of each skid member to the ball striking face 12 and the angle between the ball striking face and the vertical always equals 90 degrees. This is true for the deeply lofted clubs as well as those having a minimal loft angle. Thus, with any of the clubs, the sole 24 is raised above the ground surface and only the skid members 28 and 30 are used to make initial contact with the ground.

It will be appreciated that with the sole raised above the ground by the formation of skid members on the sole, the golf club, when it is swung to execute a golf shot, will not have a tendency to either dig into the ground surface or to bounce when contacting the ground surface because of the minimum amount of surface engaging area on the skid members. Therefore, the club will easily glide through and over the ground surface whether the ground be normal grass turf, heavy grass, dirt, sand, or other material from which a golf shot must be played.

Figure 5:
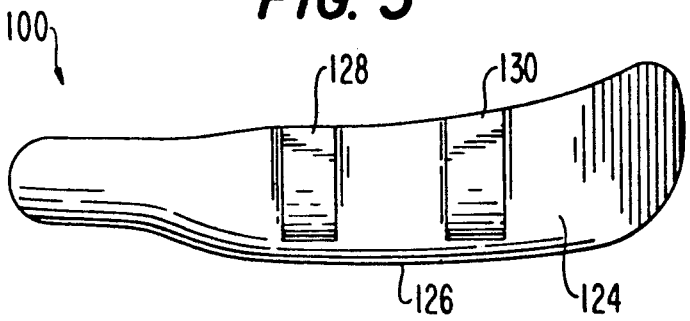
FIG. 5 is a bottom view of a second embodiment of a golf club head of the present invention.

FIG. 5 illustrates a golf club head 100 having a pair of skid members 128 and 130 which are positioned on the sole 124 behind the leading edge 126. In this embodiment, only the rear portion of the sole 124 is raised from the ground surface providing a less dramatic, but nonetheless, effective ground engaging structure suitable for certain types of grass and/or other ground conditions.

Figure 6:
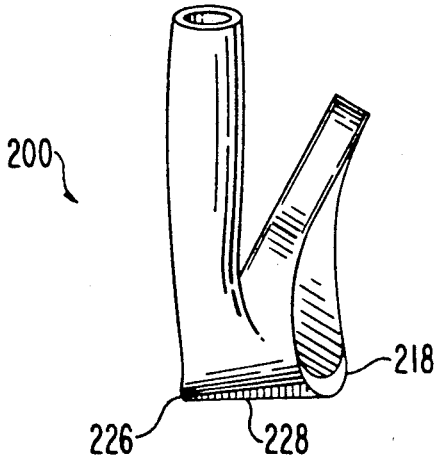
FIG. 6 is an end elevational view of a third embodiment of a golf club head of the present invention.

FIG. 6 illustrates a golf club head 200 wherein a skid member 228 tapers from a point coincident with the leading edge 226 of the club head to a point coincident with the rear surface 218.

Figure 7:
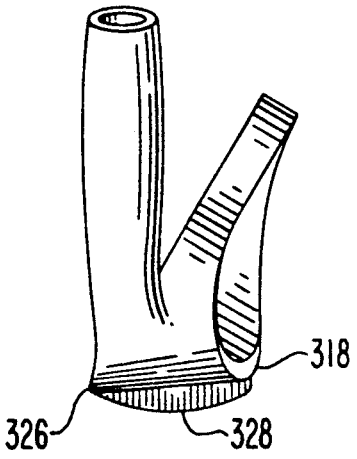
FIG. 7 is an end elevational view of a fourth embodiment of a golf club head of the present invention.

FIG. 7 illustrates a golf club head 300 wherein a skid member 328 is generally arcuate in shape and increases in size from the leading edge 326 to the rear surface 318.

Figure 8:
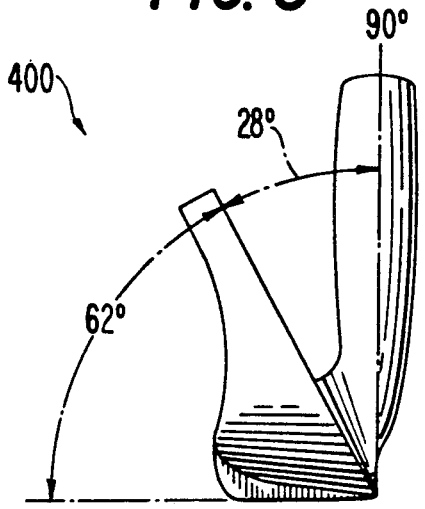
FIG. 8 is an end elevational view of a fifth embodiment of a golf club head of the present invention.
Figure 9:
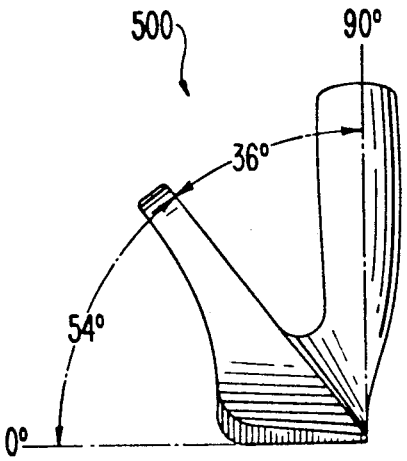
FIG. 9 is an end elevational view of a sixth embodiment of a golf club head of the present invention.
Figure 10:
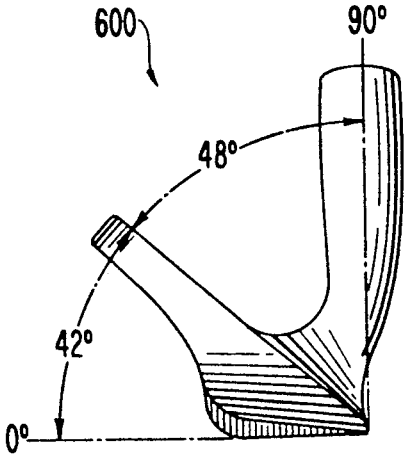
FIG. 10 is an end elevational view of a seventh embodiment of a golf club head of the present invention.

FIGS. 8, 9 and 10 show golf club heads 400, 500 and 600 having respectively increasing loft angles of 28 degrees, 36 degrees and 48 degrees. In these embodiments, the skid members 428, 528 and 628, extend upwardly onto the rear surfaces 418, 518 and 618.

Figure 11:
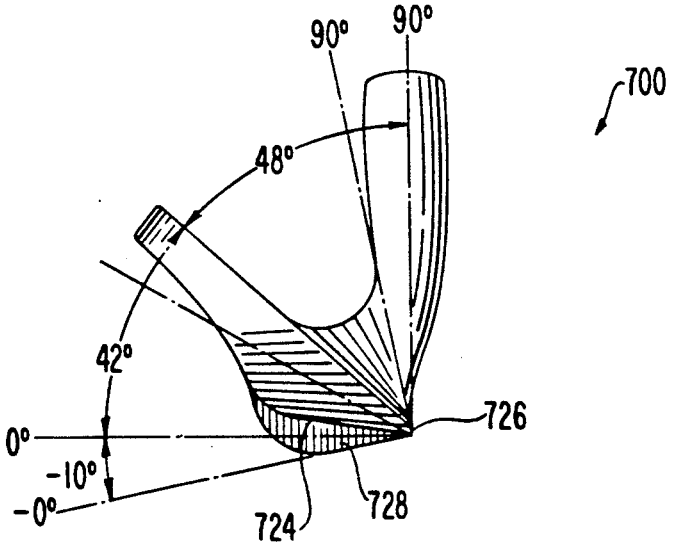
FIG. 11 is an end elevational view of an eighth embodiment of a golf club head of the present invention.

FIG. 11 shows a club head 700 specifically designed for sandtraps and heavy grass lies wherein a skid member 728 begins at the leading edge 726 and tapers downwardly at an angle (shown as −10 degrees) below the horizontal (shown at 0 degrees) thereby further raising the sole 724 above the ground.

It will be appreciated that modifications may be made in the above described structure in keeping within the scope of the invention as defined in the following claims.

I claim:

1. An iron type golf club head having a hosel, ball striking face, heel, toe, rear surface, sole and a leading edge at the juncture of said sole and said ball striking face, wherein the improvement comprises:

a pair of spaced, elongated skid members projecting outwardly from the sole for minimizing friction and suction between said golf club head and a ground surface contacted by the club head during a swing to reduce turning, torquing, and deceleration of said club head;

said skid members having a ground engaging surface with a forward portion being substantially coincident with said leading edge;

said skid members each having a height, measured from said sole to said ground engaging surface, that tapers toward said leading edge, so that said height progressively decreases toward said leading edge, thereby raising said sole above the ground surface in a front-to-rear direction between said leading edge and said rear surface.

2. The golf club head of claim 1 being further characterized by said skid member having sides which are increasingly larger in the front to rear direction.

3. The club head of claim 1 wherein the longitudinal axis of each of said skid member extends int eh front to rear direction of the club head between said leading edge and said rear surface.

4. The golf club head of claim 1 further characterized by said skid members including a first member which is located on said sole adjacent said heel and a second skid member which is located on said sole adjacent said toe.

5. The golf club head of claim 1 wherein said skid members have flat ground engaging surfaces.

6. The golf club head of claim 1 wherein said skid members have arcuate ground engaging surfaces.

7. An iron type golf club head having a ball striking face, rear surface, sole and a leading edge at the juncture of said ball striking face and sole, the iron type golf club comprising:

a pair of spaced apart, elongated skid members in the form of raised formations projecting outwardly from said sole for minimizing friction and suction between said golf club head and a ground surface contacted by said club head during a swing to reduce turning, torquing, and deceleration of said club head;

said skid members extending transversely between the front and rear faces of the club head;

each said skid member having a ground engaging surface that at its most forward position does not extend from said sole beyond the leading edge;

said skid members each having a height, measured from said sole to said ground engaging surface, that tapers toward said leading edge, so that said height progressively decreases toward said leading edge, thereby raising said sole above the ground surface in a front-to-rear direction between said leading edge and said rear surface.

8. The golf club head of claim 1 wherein each of said skid members are spaced apart at least ½ inch.

9. The golf club head of claim 8 wherein each of said skid members has a width of approximately 0.3 inches and a length of approximately 0.75 inches to 1.25 inches long.

10. The golf club head of claim 7 wherein said skid members are further characterized by contour surfaces.

11. The golf club head of claim 7, wherein the most forward portion of each of said skid members is spaced from said leading edge along said sole.

12. The golf club head of claim 7, wherein the most forward portion of said ground engaging surface is substantially coincident with the leading edge.

13. The golf club head of claim 7, wherein said skid members have flat ground engaging surfaces.

14. The golf club head of claim 7, wherein said skid members have arcuate ground engaging surfaces.

15. The golf club head of claim 7, wherein the most rearward portion of each of said skid members is spaced from said rear surface.

16. The golf club head of claim 7, wherein said skid members are characterized by contoured surfaces.

17. The golf club head of claim 7, wherein the golf club head has a hosel to accept a shaft and wherein the ground engaging surface of said skid members maintains a substantially 90° angle with respect to the axis of the hosel.

18. The golf club head of claim 7, wherein each skid member is located on opposite sides of and substantially an equal distance from, the center of gravity of the club head.

* * * * *